US007765841B2

(12) United States Patent
Hogendoorn et al.

(10) Patent No.: US 7,765,841 B2
(45) Date of Patent: Aug. 3, 2010

(54) QUALITY ANALYSIS OF TUBE BENDING PROCESSES INCLUDING MANDREL FAULT DETECTION

(75) Inventors: Paul Hogendoorn, London (CA); Michael Reeve, London (CA); Mark Adam Livingston Donkers, London (CA)

(73) Assignee: OES, Inc., London, Ontario (CA)

( * ) Notice: Subject to any disclaimer, the term of this patent is extended or adjusted under 35 U.S.C. 154(b) by 839 days.

(21) Appl. No.: 11/675,848

(22) Filed: Feb. 16, 2007

(65) Prior Publication Data

US 2007/0186603 A1 Aug. 16, 2007

(51) Int. Cl.
*B21D 7/02* (2006.01)
*B21B 37/00* (2006.01)

(52) U.S. Cl. ..... 72/19.8; 72/17.2; 72/20.1; 72/21.4; 72/149; 72/369

(58) Field of Classification Search ..... 72/16.4, 72/17.3, 21.1, 149, 155, 369, 391.2, 391.6, 72/17.2, 19.8, 20.1, 21.4
See application file for complete search history.

(56) References Cited

U.S. PATENT DOCUMENTS

| | | | | | |
|---|---|---|---|---|---|
| 5,259,224 | A * | 11/1993 | Schwarze | ..... | 72/16.4 |
| 5,343,725 | A * | 9/1994 | Sabine | ..... | 72/155 |
| 5,526,669 | A * | 6/1996 | Gjovik et al. | ..... | 72/391.2 |
| 5,678,441 | A * | 10/1997 | Schwarze | ..... | 72/149 |
| 5,682,781 | A * | 11/1997 | Schwarze | ..... | 72/149 |
| 5,797,289 | A * | 8/1998 | Hoshino | ..... | 72/17.3 |
| 5,819,574 | A * | 10/1998 | Yogo | ..... | 72/155 |
| 6,125,680 | A * | 10/2000 | Bradbury et al. | ..... | 72/391.6 |
| 6,253,595 | B1 * | 7/2001 | Lewis, Jr. | ..... | 72/369 |
| 7,331,205 | B2 * | 2/2008 | Chitty et al. | ..... | 72/21.1 |

* cited by examiner

*Primary Examiner*—David B Jones
(74) *Attorney, Agent, or Firm*—Carlson, Gaskey & Olds PC

(57) ABSTRACT

A disclosed device and method are useful for monitoring a tube bending process. An example sensor detects a force associated with moving a mandrel in tubing during at least a portion of a tube bending process. The detected force is used to determine a quality of the tube bending process. For example, a detected pulling force provides an indication of whether a bent portion of a tube is within an acceptable range of a desired configuration. The detected pulling force is also useful to provide an indication of whether a condition of a mandrel or a machine used during the process is as expected.

20 Claims, 3 Drawing Sheets

QUALITY ANALYSIS OF TUBE BENDING PROCESSES INCLUDING MANDREL FAULT DETECTION

CROSS-REFERENCE TO RELATED APPLICATIONS

This application claims priority to U.S. Provisional Application No. 60/773,980 filed Feb. 16, 2006.

BACKGROUND

This invention relates to quality analysis for tube bending processes.

Tubing is used extensively in a variety of situations. One example is exhaust systems for the automotive industry. Tubing manufacture involves numerous processes including cutting, bending, welding and forming. Exhaust tubing is bent to desired shapes for particular vehicle applications using automated equipment that must be capable of high accuracy and repeatability when bending tubing over a wide range of angles. The tubing must be bent without splitting, cracking or collapsing for a wide range of materials (e.g., steel) and thicknesses.

One typical automatic tube bending machine inserts a set of mandrel balls into a tube to support a portion of the tube while that portion is being bent to a desired shape. The mandrel balls are then pulled back automatically by a motor or hydraulic drive mechanism to the next bend position. Occasionally, the mandrel balls will break during the tube bending process as a result of excessive tension or pull force, which may leave mandrel fragments inside the tubing. As a result, mandrel scrap inside the tubing may be assembled into an exhaust system that is later installed onto a vehicle. On occasion this problem has not been discovered until the vehicle has been fully assembled. Troubleshooting problems with the vehicle relating to the presence of mandrel fragments in the exhaust system is difficult and costly. To avoid such problems, OEMs are requiring exhaust system suppliers to incorporate a detection system that ensures that exhaust systems are delivered without mandrel fragments.

One approach to mandrel fragment detection has been to use a camera system to visually detect the presence of mandrel fragments. The use of camera systems has not been that successful since such systems require significant modification to the machine and have resulted in reduction of machine productivity and high maintenance due to the dirty and harsh environments within which the camera systems must perform. Accordingly, a more robust and reliable detection system is needed to determine undesired conditions.

SUMMARY

An example method of monitoring a tube bending process includes determining a force associated with moving a mandrel in a tube. A quality of the tube bending process is determined based on the determined force.

In one example, a pulling force is determined and used to determine at least one of a condition of the mandrel or a condition of the tube such as whether a portion of the tube is bent within an acceptable range of an expected configuration.

An example device for monitoring a tube bending process includes a sensor that detects a force associated with moving a mandrel in a tube. A controller uses the detected force to determine at least one quality of the tube bending process.

The various features and advantages of disclosed examples will become apparent to those skilled in the art from the following detailed description. The drawings that accompany the description can be briefly described as follows.

DETAILED DESCRIPTION

Figure 1:
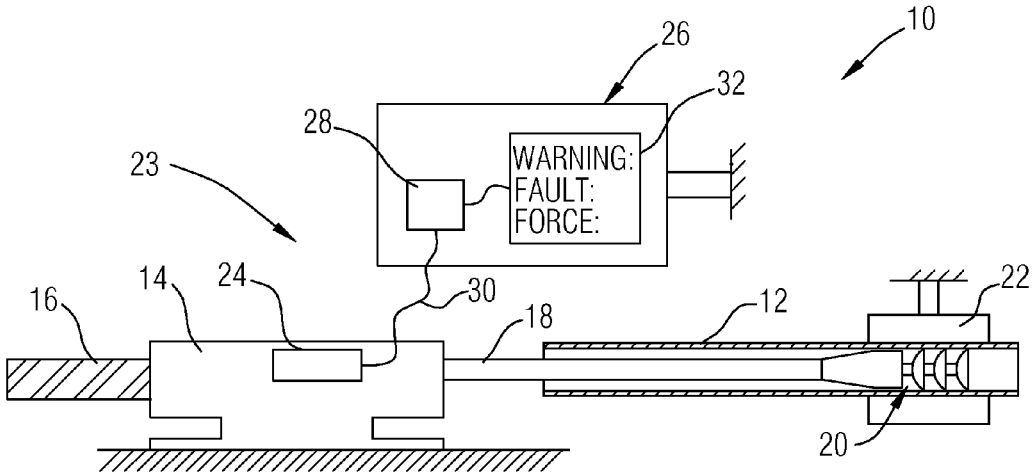
FIG. 1 is a schematic view of one example tube bending machine using an example embodiment of this invention.

A tube bending machine 10 is shown in FIG. 1 that is used to bend tubing 12 into a desired shape. The tubing 12 is manipulated by the machine 10 to provide numerous bends along its length such that it can be used for a desired application. One example tube bending machine and process is useful for shaping tubing that is used as part of a vehicle exhaust system. The machine 10 in other examples performs a bending process for other tube configurations. Given this description, those skilled in the art will realize the various types of tube bending processes that can be monitored using an embodiment of this invention.

The example machine 10 includes a motor 14 having a device such as a ball screw 16 that is coupled with a rod 18. A mandrel 20 is supported at an end of the rod 18 and includes multiple pieces that are so-called "mandrel balls" that support the inside of the tubing 12 in a known manner as the tubing is bent by a tube bender 22. The mandrel pieces articulate relative to one another so that they can be moved through the bends in the tubing and accommodate the angles of the bend. The motor 14 provides a moving force for moving the mandrel in the tubing 12 as needed to complete a tube bending process. For example, the motor 14 forces the mandrel 20 into tubing stock (i.e., pushes the mandrel in one direction) at the beginning of a tube bending process. This action is useful for placing the mandrel 20 in a location where a bend is desired so that the mandrel 20 provides the desired support to the tubing 12 at the location of a bend during the bending process.

In another example, a hydraulic machine is used for manipulating a mandrel within the tubing.

After the tubing 12 is bent in the area of the mandrel 20, the motor 14 retracts the rod 18 and mandrel 20 (i.e., pulls the mandrel in an opposite direction) to the next location along the tubing 12 where it will be bent. The motor 14 also generates a moving force that removes the mandrel 20 from the tubing after the tube bending process is complete in some examples.

During the tube forming process, several conditions may occasionally occur that are associated with less than optimum quality. For example, some situations such as insufficient lubrication of the mandrel 20 can result in one or more of the pieces 22 of the mandrel 20 breaking. Similarly, contaminants can interfere with proper mandrel operation or movement. One example use of the illustrated assembly includes the realization that such undesirable conditions typically are associated with a higher than normal force required to move the mandrel 20. For example, it requires a larger moving force to retract the mandrel 20 around a bent portion of the tubing 12 if the mandrel is insufficiently lubricated or a mandrel piece 22 is broken.

An example quality monitoring device 23 monitors the force required to move the mandrel 20 to determine if a condition exists that might interfere with obtaining a desired level of quality from the tube forming machine 10. The illustrated example includes a sensor 24 that detects the force required to move the mandrel 20 within the tubing 12 during various portions of a tube bending process. One example sensor 24 comprises a strain transducer that detects a pulling force exerted to move the mandrel 20 through a bent portion of the tubing 12. The strain transducer 24 in one example detects strain on one of the motor 14, the coupling between the ball screw 16 and rod 18, the coupling between the rod 18 and the mandrel 20, or a portion of the mandrel. The detected strain corresponds to the force necessary to complete the movement of interest. In one example, the strain transducer 24 is a commercially available piezoelectric sensor.

The sensor 24 communicates with a controller 26 to provide information to a detected force processor 28. A communication coupling is schematically shown at 30, which may comprise a hard-wired connection or a wireless communication link, for example. The controller 26 includes a display 32 that is used by the operator for observing an output from the controller and to input information for configuring the device 23, if desired. The output of the controller 26 is useful to monitor a quality of a tube bending process based upon the force detected by the sensor 24 during at least selected portions of the operation of the tube forming machine 10.

Figure 2:
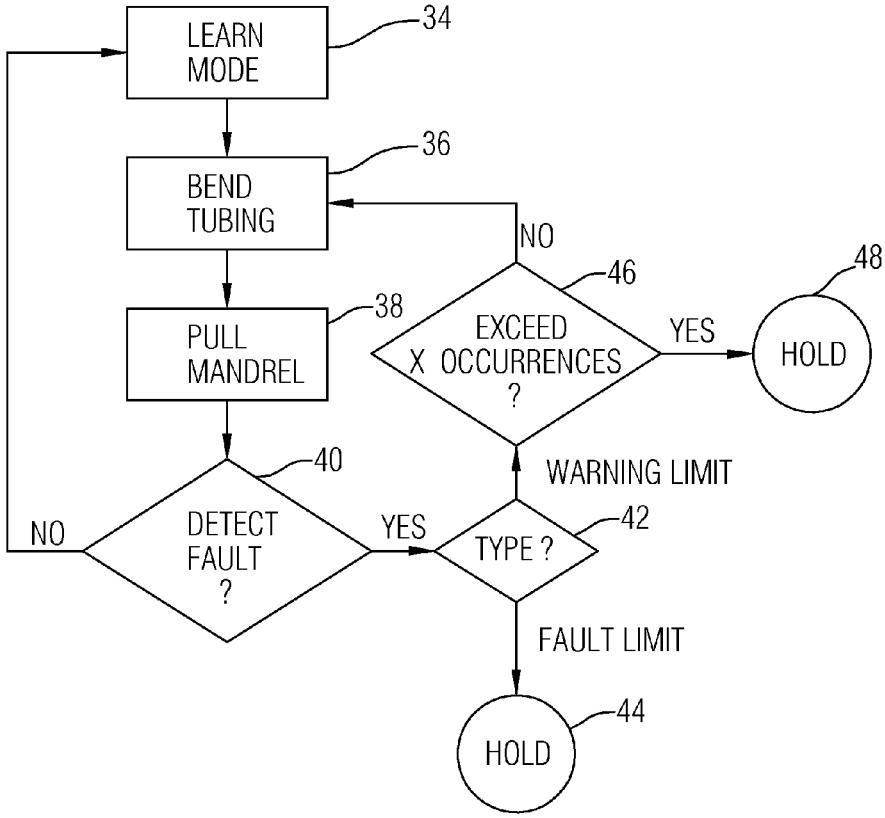
FIG. 2 is a flowchart of an example process.

A flowchart indicative of an example quality monitoring process is shown in FIG. 2. This example begins with a "learn mode" indicated at 34. The learn mode in one example includes monitoring forces associated with manufacturing parts of an acceptable quality using equipment in a desirable condition under appropriately supervised and controlled conditions. The learn mode is useful for the controller 26 to learn typical forces associated with moving the mandrel while making a good part. Such information can then be used to determine whether detected forces during a tube bending process indicate at least on of various potential fault conditions.

The controller 26 in one example is programmed to recognize a variety of actual or potential fault conditions. A broken mandrel piece 22 is one example of an actual fault condition that requires immediate attention. A mandrel with less than a desired amount of lubrication is one example of a potential fault condition because less than optimum lubrication may be acceptable for some time before any problems arise. Different levels of detected force compared to the forces determined during the learn mode provide information regarding the nature of a condition of the tube bending machine 10 or the tubing 12, either of which can be considered to correspond to a quality of the tube bending process.

For example, the pulling force for moving a mandrel without lubrication may be around 50% greater than the pulling force needed for a mandrel having proper lubrication. The pulling force on a broken mandrel may be around double the pulling force on a good mandrel.

One feature of the illustrated example, it that it is possible to detect a potential fault condition before one occurs. Once the pulling force for each bend area of a particular part is learned, an operator or the controller 26 can set limits to alert the operator of an actual undesired condition or an impending undesired condition.

During a tube bending operation, the tubing is bent, as indicated at 36. The mandrel is pulled to the next desired location, as indicated at 38. While the mandrel is being pulled through the tubing, the device 23 monitors the pulling force to determine if it deviates significantly from expected values, as indicated at 40. If the detected pulling force is within a desired range of an expected or acceptable pulling force, then the tube bending operation continues. However, if the pulling force is outside of the desired operating range, then one or more faults may be indicated.

In one example, two fault criteria are used. The first fault criteria is associated with a condition that is a "fault limit" in which the pulling force corresponds to or falls within a range indicative of a catastrophic condition such as a broken mandrel. Upon detecting such a pulling force, the tube bending process is placed "on hold," as indicated at 44, so that the operator can inspect the tube bending machine, the mandrel or both. In one example, the display of the controller 26 provides information regarding the detected force and an expected or suspected problem. This allows for addressing an equipment problem and facilitates identifying parts that should be inspected or rejected.

Another fault criteria is associated with a condition in which the detected pulling force falls within a "warning limit." This type of fault may occur if, for example, a pulling force, which is outside the desired operating range but less than the fault limit, is detected a predetermined number of times or a predetermined number of successive occurrences, as indicated at 46. In such an event, the tube bending process is at least temporarily held, as indicated at 48. This allows an operator to take corrective action such as maintenance on the tube forming machine, which may include adding lubricant to the mandrel 20. If a predetermined number of occurrences have not been met, then a fault will not be indicated and the tube forming process can continue since the higher than normal pulling force is presumed insignificant.

Figure 3A:
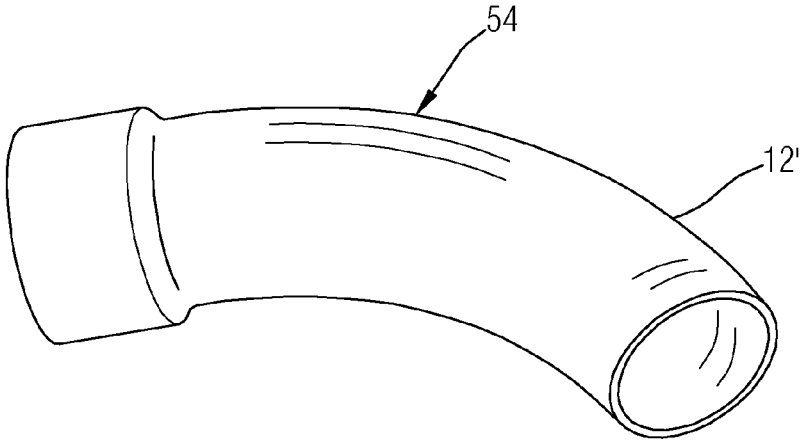
FIGS. 3A and 3B show one example feature of an example embodiment.
Figure 3B:
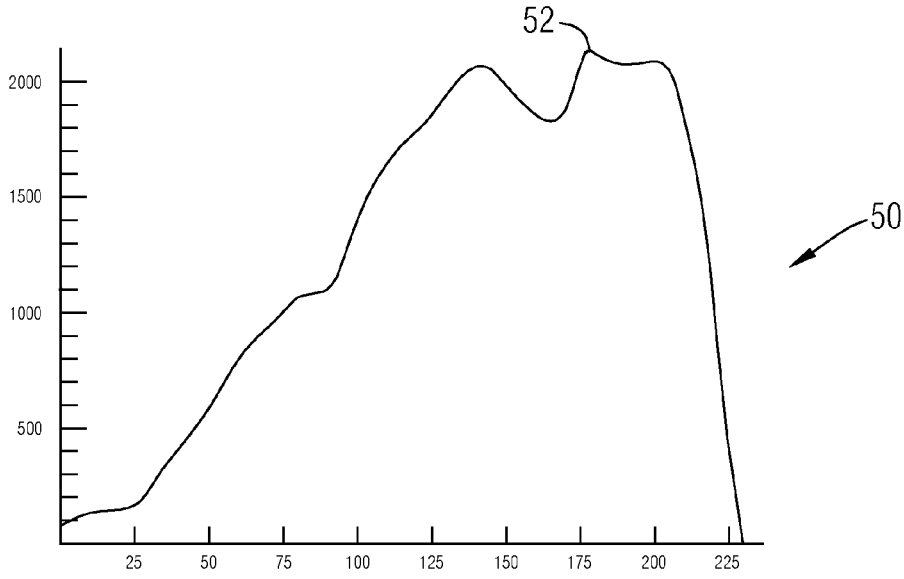

FIGS. 3A and 3B schematically show one example feature of the example embodiment of FIG. 1. In this example, the device 23 provides an output on the display 32 including a force signature 50 (FIG. 3B) associated with manipulating the mandrel 20 within an example tube 12' (FIG. 3A). This particular example includes a 350 bend within the portion 54 of the tube 12' shown in FIG. 3A. As can be appreciated from the illustration, the force curve 50 gradually increases to a peak value shown near 52. In one example, the peak value of the pulling force is used for analyzing whether the forces associated with manipulating the mandrel 20 within the tube 12' are within an acceptable range. Other features of the force curve 50 may be used for analysis purposes, depending on the needs of a particular situation. For example, an area beneath a force curve or an envelope established by a force curve can be used as an indicator of a force required to move the mandrel 20 through a portion of a tube.

One use of the force curve 50 is to determine whether the forces associated with manipulating the mandrel 20 are within an acceptable range. Another use of the force curve is to make a determination whether the actual bend angle of the tube is within a desired range.

Figure 4A:
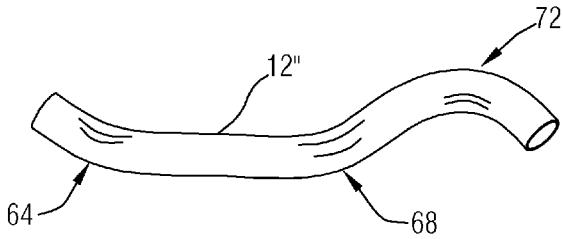
FIGS. 4A and 4B show another example feature.
Figure 4B:
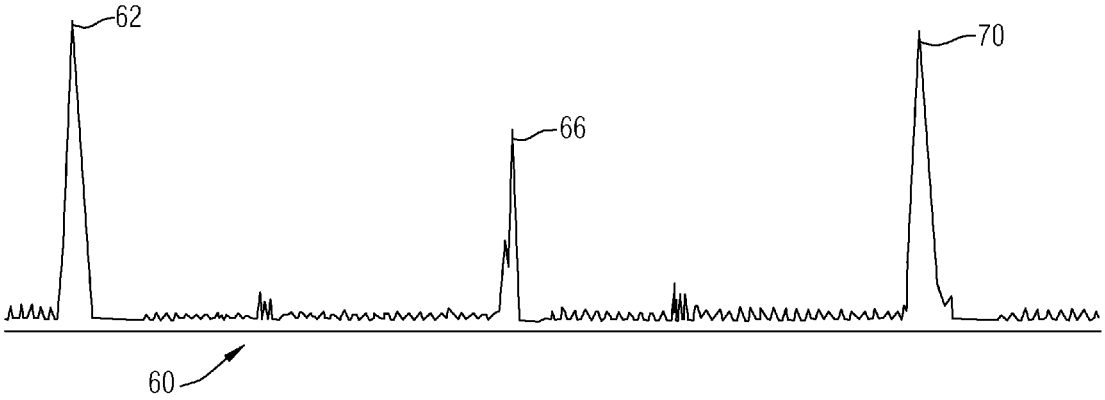

As shown in FIG. 4A, a plurality of different bend angles may be established along different portions of a tube 12". As shown in FIG. 4B, a force curve signature 60, which is displayed on the display 32 in one example, has different peak values associated with the different amount of bending (e.g., the number of degrees) along different portions of the tube 12". A first peak 62 on the curve signature 60 corresponds to a force for moving the mandrel 20 through a bend at 64 in the tube 12". A second peak 66 corresponds to a bend at 68 and a third peak 70 corresponds to a bend at 72. In the illustrated example, the mandrel 20 was moved from left to right through the tube 12" during the bending process.

As can be appreciated from the illustration, the larger the magnitude of the degrees associated with a bend, the higher the force associated with manipulating the mandrel 20 within that portion of the tube. Different forces are expected for moving the mandrel 20 through different portions of the tubing 12". By determining an expected force associated with a particular degree of bending, one example device 23 is capable of providing an output indicating whether a portion of a tube is bent at an expected bend angle. The detected force provides an indication of the actual bend angle or configuration of the tube at a particular location.

One example use of the force information in this regard is to provide an indication whether a part is configured according to a specification. For example, a detected force that is outside of an acceptable range of an expected force (based on the expected bending angle) provides an indication that a part may not have a desired configuration. This may be useful, for example, in situations where the mandrel 20 is fine and properly lubricated but the operation of a tube forming machine may be otherwise in question or under inspection.

Another feature that can be appreciated from FIG. 4B is that for different magnitudes of bend angles, different tolerances or acceptable ranges may be used for determining whether the forces associated with manipulating the mandrel 20 are within an acceptable range. For example, the lower peak force associated with a 19° bend (shown at 66 and 68) is significantly less than that associated with a bend on the order of 55° (shown at 62 and 64) or 75° (shown at 70 and 72), for example. It may be useful in some situations to use a smaller range of variation to describe the acceptable limits for one bend angle compared to another bend angle, for example. In other words, knowledge regarding the different levels of expected force for different bend angles allows for customizing the range of acceptable forces along each portion of a tube that includes a variety of angles. In one example, the acceptable ranges vary with the magnitude of the bend angle.

Another example uses compression force information during mandrel insertion (e.g., prior to bending the tube) as a quality check. For example, it is possible for a misalignment of one or more parts to result in a jam. If a drive mechanism of the motor 14 pushes sufficiently on a jammed mandrel, that can weaken, damage or break the machine or the mandrel. One example device 23 includes a checkpoint or maximum acceptable compression force. If the sensor 24 provides a force value exceeding the checkpoint, the machine is paused to avoid problems and to make any needed corrections.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of monitoring a tube bending process, comprising:

bending a portion of a tube having a mandrel disposed therein for supporting the portion of the tube being bent, determining a force associated with moving a mandrel within the tube after the tube has been bent; and using the determined force as an indication of a quality of the tube bending process.

2. The method of claim 1, comprising determining a pulling force associated with moving the mandrel along the portion of the tube that was bent during the bending process.

3. The method of claim 2, comprising using a strain sensor to determine a strain on one of the mandrel, a mover that provides the pulling force or a connector that couples the mandrel to the mover.

4. The method of claim 1, comprising determining a compressive force associated with moving the mandrel along a portion of the tube.

5. The method of claim 1, comprising generating a force curve indicative of the force associated with moving the mandrel; and determining whether at least one characteristic of the generated force curve is within an acceptable range.

6. The method of claim 5, comprising determining a peak value of the force curve associated with the movement of the mandrel along a selected portion of the tube.

7. The method of claim 5, wherein the tube bending process includes bending a plurality of portions of the tube a corresponding plurality of different angles and comprising determining a tolerance range for the at least one characteristic for each of the plurality of angles, respectively; and determining whether the at least one characteristic associated with each of the plurality of angles is within the corresponding tolerance range.

8. The method of claim 7, comprising varying the tolerance ranges according to a magnitude of the respective angles.

9. The method of claim 1, comprising determining whether the determined force indicates an undesirable condition of the mandrel.

10. The method of claim 1, comprising determining whether the determined force indicates that a bent portion of the tube is bent within an acceptable range of an expected configuration.

11. The method of claim 1, comprising determining whether the determined force meets a first criteria or a second criteria;

providing a first indication if the determined force meets the first criteria; and providing a second, different indication if the determined force meets the second criteria.

12. The method of claim 11, wherein the first criteria corresponds to a problem with the mandrel that requires immediate attention and the second criteria corresponds to a potential problem with the mandrel that may require attention if the second criteria is met during a selected number of bends.

13. A device for monitoring a tube bending process, comprising;

a tube bender that bends a portion of a tube, a mandrel disposed in the portion of a tube that supports the portion of a tube being bent as the portion of a tube is being bent, a sensor that detects a force associated with moving the mandrel within the tube after bending, and a controller that determines whether the force detected by the sensor corresponds to a desired quality of the tube bending process.

14. The device of claim 13, wherein the controller determines whether the detected force indicates an undesirable condition of the mandrel.

15. The device of claim 13, wherein the controller determines whether the detected force indicates that a portion of the tube is bent within an acceptable range of an expected configuration as a result of the tube bending process.

16. The device of claim 13, wherein the sensor detects at least one of a compressive force or a pulling force associated with moving the mandrel in the tube.

17. The device of claim 13, wherein the controller provides a force curve output indicative of the force associated with moving the mandrel and determines whether at least one characteristic of the generated force curve is within an acceptable range.

18. The device of claim 17, wherein the tube bending process includes bending a plurality of portions of the tube a corresponding plurality of different angles and the controller determines a tolerance range for the at least one characteristic for each of the plurality of angles, respectively, and determines whether the at least one characteristic associated with each of the plurality of angles is within the corresponding tolerance range.

19. The device of claim 18, wherein the controller uses a tolerance range that is set based on a magnitude of the respective angles.

20. The device of claim 13, wherein the controller determines whether the determined force meets a first criteria or a second criteria;

provides a first indication if the determined force meets the first criteria; and provides a second, different indication if the determined force meets the second criteria.

* * * * *